US007651377B2

(12) United States Patent
Lin

(10) Patent No.: US 7,651,377 B2
(45) Date of Patent: Jan. 26, 2010

(54) ELECTRICAL CARD CONNECTOR ASSEMBLY

(75) Inventor: Kuo-Lung Lin, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/157,628

(22) Filed: Jun. 11, 2008

(65) Prior Publication Data

US 2008/0305688 A1 Dec. 11, 2008

(30) Foreign Application Priority Data

Jun. 11, 2007 (TW) ..... 96120927

(51) Int. Cl.
*H01R 24/00* (2006.01)

(52) U.S. Cl. ..... 439/630

(58) Field of Classification Search ..... 439/630–637
See application file for complete search history.

(56) References Cited

U.S. PATENT DOCUMENTS 6,991,480 B2 1/2006 Katayanagi et al.
2006/0079119 A1 * 4/2006 Wu ..... 439/492

* cited by examiner

*Primary Examiner*—Ross N Gushi
(74) *Attorney, Agent, or Firm*—Andrew C. Cheng; Wei Te Chung; Ming Chieh Chang

(57) ABSTRACT

An electrical card connector assembly (100) comprises an insulating housing (10), a plurality of terminals (20) received in the insulating housing, and a plurality of cables (50). The insulating housing comprises a main body (110), a pair of arms (120) extending from the opposite ends of the main body, a tongue portion (130) extending from the main body and sandwiched by the arms, and a positioning portion (140) extending from the main body opposite to the tongue portion, the positioning portion alternatively defines a plurality of channels (145). Each terminal comprises a tail portion (230) received in corresponding channel of the positioning portion. Each cable comprises a conductor located in corresponding channel of the positioning portion and electrically connecting with the tail portion of the terminal.

12 Claims, 4 Drawing Sheets

ELECTRICAL CARD CONNECTOR ASSEMBLY

BACKGROUND OF THE INVENTION

1. Field of the Invention

The present invention generally relates to an electrical card connector assembly, and more particularly to an electrical card connector assembly having a positioning member.

2. Description of Prior Art

Modern times, the PC card is always used as an external equipment for increase the storage of the electrical consumer products, like Mobile phone, Digital camera, etc. The electrical card connector is used for electrically connecting the PC card and the electrical consumer products. Usually, the electrical card connector is mounted on a printed circuit board. However, sometimes, the electrical card connector is soldered to the cables, accordingly, how to located the cables is a new problem for us.

Hence, it is desirable to have an improved card connector to overcome the above-mentioned disadvantages of the prior art.

BRIEF SUMMARY OF THE INVENTION

Accordingly, the object of the present invention is to provide an electrical card connector, which is easily soldered to a plurality of cables.

In order to achieve the above-mentioned object, an electrical card connector assembly, comprises an insulating housing, a plurality of terminals received in the insulating housing, and a plurality of cables. The insulating housing comprises a main body, a pair of arms extending from the opposite ends of the main body, a tongue portion extending from the main body and sandwiched by the arms, and a positioning portion extending from the main body opposite to the tongue portion, the positioning portion alternatively defines a plurality of channels. Each terminal comprises a tail portion received in corresponding channel of the positioning portion. Each cable comprises a conductor located in corresponding channel of the positioning portion and electrically connecting with the tail portion of the terminal.

Other objects, advantages and novel features of the invention will become more apparent from the following detailed description of the present embodiment when taken in conjunction with the accompanying drawings.

DETAILED DESCRIPTION OF THE INVENTION

Figure 1:
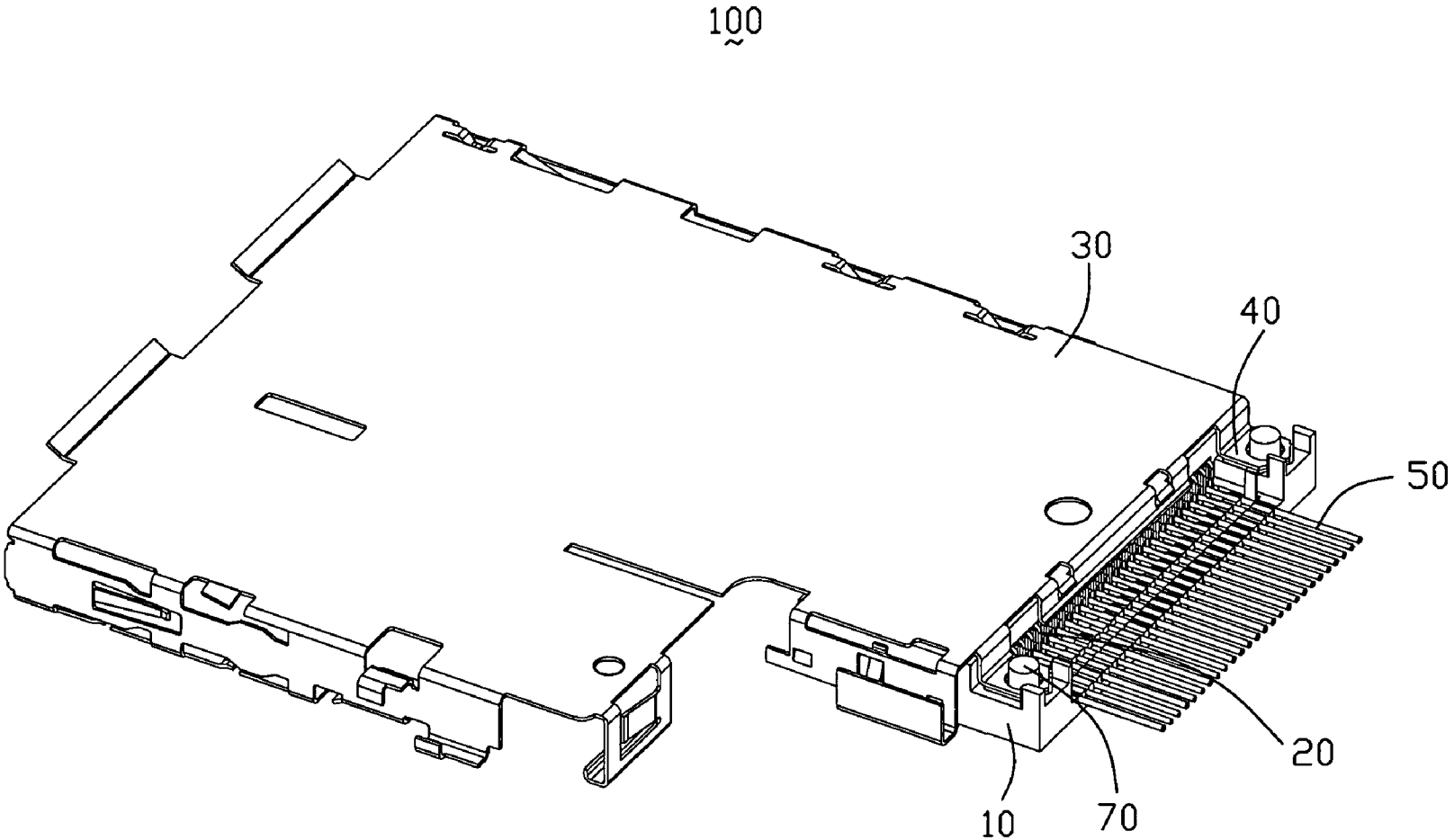
FIG. 1 is a perspective view of an electrical card connector assembly in accordance with the present invention.

Reference will now be made to the drawing figures to describe the present invention in detail.

Figure 2:
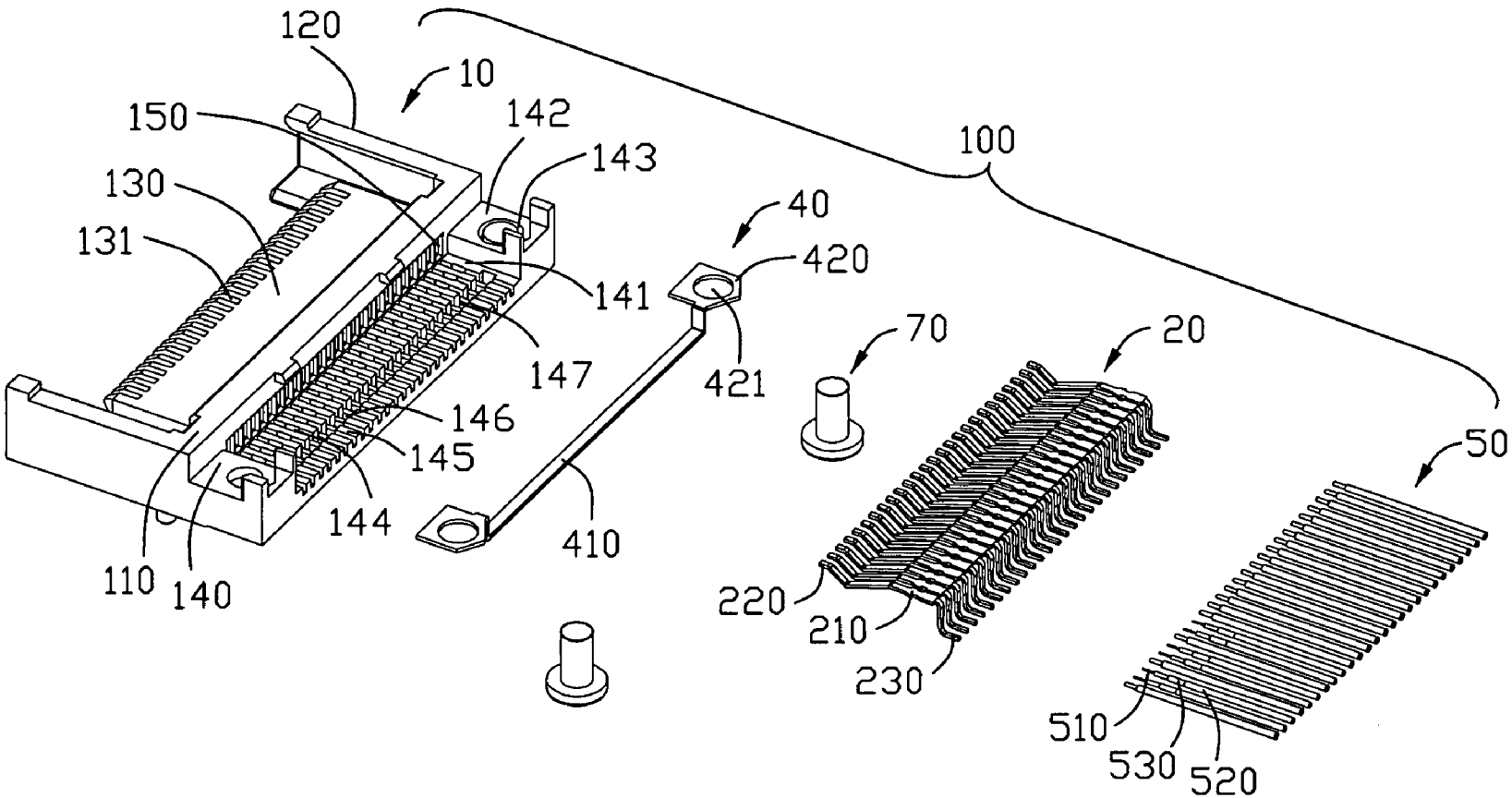
FIG. 2 is an exploded, perspective view of the card connector assembly shown in FIG. 1.
Figure 3:
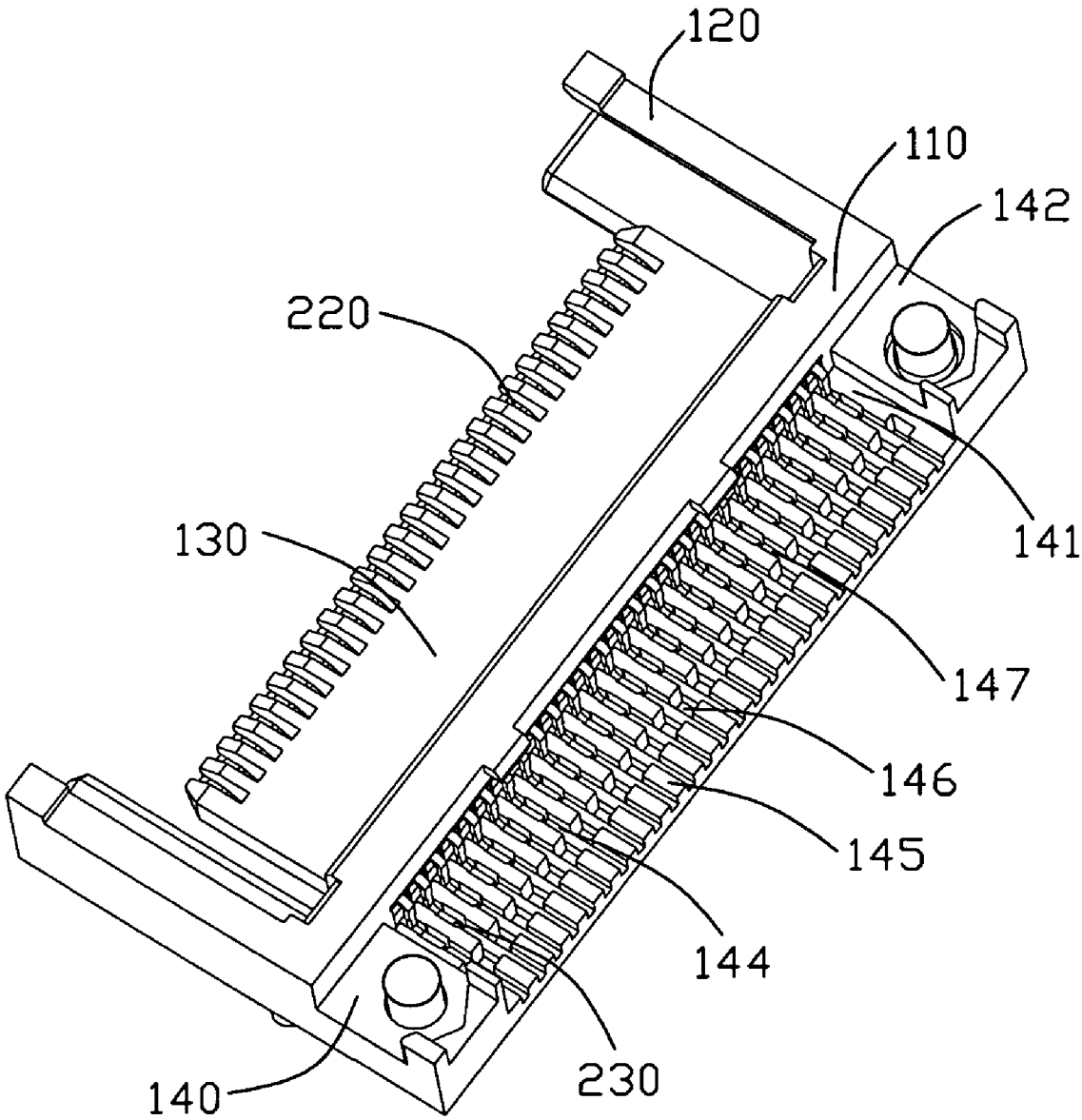
FIG. 3 is a perspective view of an insulating housing of the card connector assembly.
Figure 4:
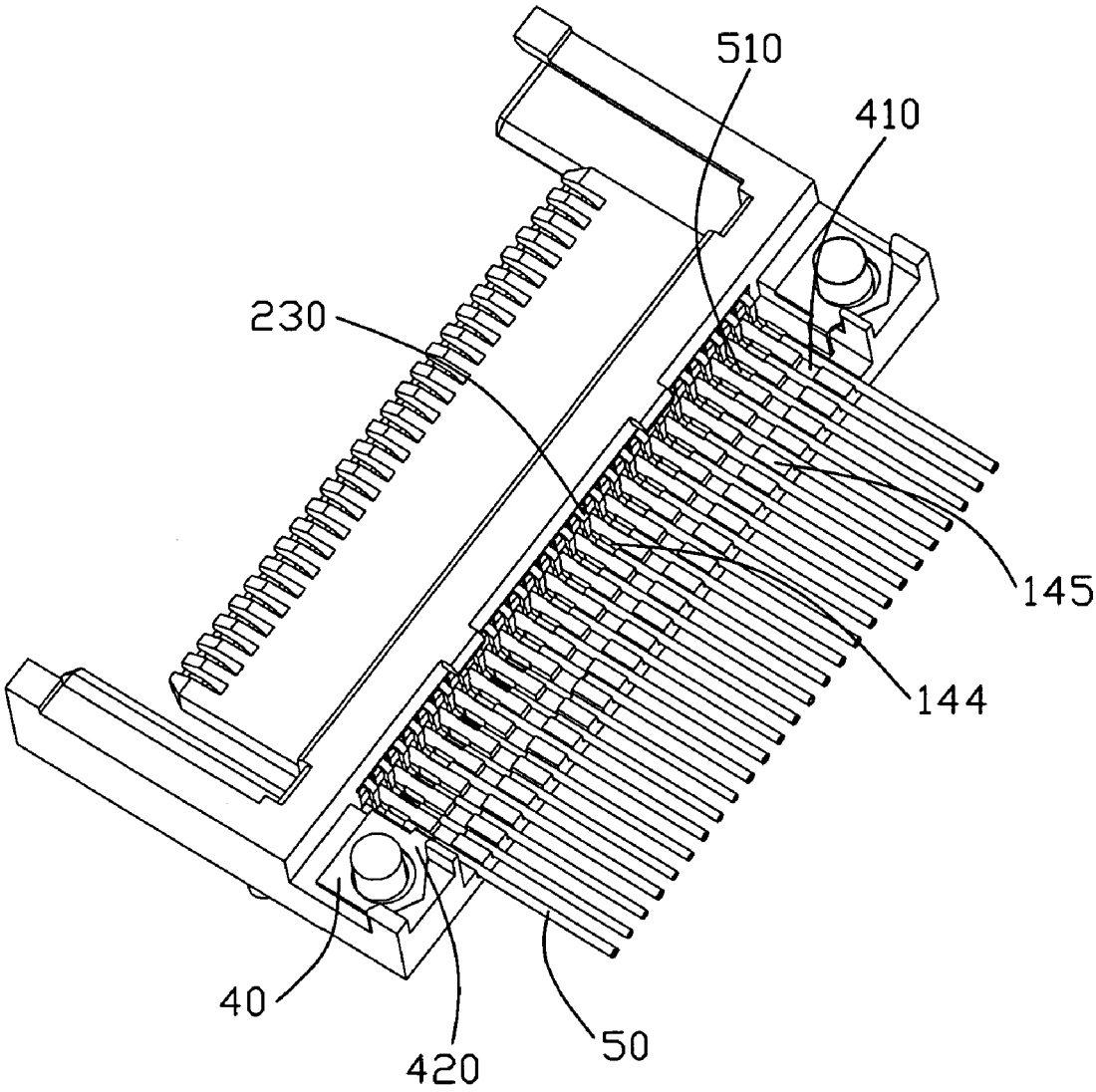
FIG. 4 is perspective view of the insulating housing and the cables.

Referring to FIG. 1 to FIG. 4, an electrical connector assembly 100 comprises an insulating housing 10, an L-shape cover 30 assembled on the insulating housing 10, a plurality of terminals 20 received in the insulating housing 10, a grounding plate 40 mounted on the insulating housing 10, and a plurality of cables 50 soldered with the terminals 20 and partially retained on the insulating housing 10.

The insulating housing 10 comprises a longitudinal main body 110, a pair of arms 120 extending from the opposite ends of the main body 110, a tongue portion 130 extending from the main body 110 and sandwiched by the arms 120, and a positioning portion 140 extending from the main body 110 opposite to the tongue portion 130. The main body 110 defines a plurality of terminal receiving channels 150, the tongue portion 130 defines a plurality of opening 131 communicating with corresponding terminal receiving channels 150. The positioning portion 140 comprises a pair of end portions 142 and a middle portion 141 connecting the two end portions 142. Each end portion 142 defines a hole extending therethrough. The middle portion 141 forms a plurality of alternative ribs 145, and every two adjacent ribs 145 defines a channels 144 therebetween corresponding to the terminal receiving channels 150. Each rib 145 defines a cutout thereon 146. These cutouts together defines a longitudinal gap 147.

The grounding plate 40 comprises a pair of mounting portion 420 and a connecting portion 410 connecting the mounting portions 420. Each mounting portion 420 defines a mounting hole 421 thereon. The grounding plate 40 is placed on the positioning portion 140 of the insulating housing 10 with the mounting portions 420 overlapped on corresponding end portions 142 and the connecting portion 410 received in the gap 147. Furthermore, the mounting hole 420 is overlapped on the hole 143 of the end portion 142. A pair of retaining screw 70 are inserted through the hole 143 and the mounting hole 420 to retain the grounding plate 40 on the insulating housing 10.

Each terminal 20 has a retaining portion 210, a mating portion 220 extending forwardly from the retaining portion 210 and a tail portion 230 extending downwardly and backwardly from the retaining portion 210 opposite to the mating portion 220. The retaining portion 210 is retained in the terminal receiving channels 150 of the main body 110, the mating portion 220 is located in the opening 131 of the tongue portion 130, and the tail portion 230 is located in the channels 144 of the positioning portion 140.

Each cable 50 comprises a conductor 510, a grounding layer 530 enclosing the conductor 510 with an insulating layer therebetween, and an outer insulating layer or jacket 520 enclosing the grounding layer 530. Each cable 50 is inserted into corresponding channel 144 in a back-to-front direction. In this direction, the gap 147 divides the channel into a front part and a rear part. The full cable 50 is inserted into the front part of the channel 144. And then the insulating layer 520 is removed and the grounding layer 530 enclosing the conductor 510 extends into the gap 147 for electrically connecting with the connecting portion 410 of the grounding plate 40. Finally, the grounding layer 530 is removed and the conductor 510 extends into the rear part of the channel 144 for electrically connecting with the tail portion 230 of the terminal 20. Thereby, the cables 50 are easily soldered to the tail portions 230 of the terminals 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector assembly, comprising:

an insulating housing comprising a main body, a pair of arms extending from opposite ends of the main body, a tongue portion extending from the main body between the arms, and a positioning portion extending from the main body opposite to the tongue portion, the positioning portion having a plurality of channels;

a plurality of terminals received in the insulating housing, each terminal comprising a tail portion received in a corresponding channel of the positioning portion;

a plurality of cables each comprising a conductor located in a corresponding channel of the positioning portion and electrically connecting with the tail portion of the terminal; and a grounding plate located on the positioning portion of the insulating housing.

2. The electrical card connector assembly as claimed in claim 1, wherein each cable comprises a grounding layer enclosing the conductor and electrically connects with the connecting portion of the grounding plate.

3. The electrical card connector assembly as claimed in claim 1, further comprising an L-shape cover.

4. The electrical card connector assembly as claimed in claim 1, wherein the positioning portion forms a plurality of ribs thereon, every two adjacent ribs defining said channel.

5. The electrical card connector assembly as claimed in claim 4, wherein each rib defines a cutout, the cutouts defining a longitudinal gap.

6. The electrical card connector assembly as claimed in claim 5, wherein the grounding plate comprises a pair of mounting portions and a connecting portion connecting the mounting portions, the connecting portion being received in the gap of the positioning portion.

7. The electrical card connector assembly as claimed in claim 6, wherein the positioning portion comprises a pair of end portions and a middle portion, said ribs and said channels are disposed on the middle portion, the mounting portions are disposed on the end portions of the positioning portion, respectively.

8. The electrical card connector assembly as claimed in claim 7, wherein the mounting portion of the grounding plate defines a mounting hole, and the end portion of the positioning portion defines a hole aligned with the mounting hole.

9. The electrical card connector assembly as claimed in claim 5, wherein the gap divides each channel into a front part and a rear part.

10. The electrical card connector assembly as claimed in claim 9, wherein the cable comprises a grounding layer enclosing the conductor and an insulating layer enclosing the grounding layer.

11. The electrical card connector assembly as claimed in claim 10, wherein the cable with the insulating layer is located in the front part of the channel, the grounding layer is exposed to the gap, and the conductor is exposed to the rear part of the channel.

12. An electrical card connector comprising:

an insulative housing defining a front mating port and a rear connection port;

a metallic shell assembled to the housing to commonly define a receiving space for receiving a card therein;

a plurality of grooves formed in a rear portion of the housing and extending in a front-to-back direction;

a plurality of contacts disposed in the housing with tails received in the corresponding grooves, respectively;

an elongated gap crossing said grooves in a transverse direction;

a metallic ground bar received in said gap; and a plurality of wires received in the corresponding grooves, respectively, and mechanically and electrically connected to the corresponding contacts via inner conductors; wherein outer conductors of the wires are mechanically and electrically connected to the ground bar.

* * * * *